United States Patent [19]

Hardiman

[11] 4,226,127

[45] Oct. 7, 1980

[54] HAND OPERATED YIELD TIGHTENING SYSTEM

[75] Inventor: Russell J. Hardiman, Quakertown, Pa.

[73] Assignee: SPS Technologies, Inc., Jenkintown, Pa.

[21] Appl. No.: 63,011

[22] Filed: Aug. 2, 1979

Related U.S. Application Data

[63] Continuation of Ser. No. 864,411, Dec. 27, 1977, abandoned.

[51] Int. Cl.[3] ..... B25B 23/142

[52] U.S. Cl. ..... 73/761; 73/139

[58] Field of Search ..... 73/761, 139

[56] References Cited

U.S. PATENT DOCUMENTS

| | | | |
|---|---|---|---|
| 2,315,521 | 4/1943 | Hart | 73/139 |
| 3,643,501 | 2/1972 | Pauley | 73/761 X |
| 3,693,726 | 9/1972 | Hornig et al. | 73/761 X |

*Primary Examiner*—Charles A. Ruehl

*Attorney, Agent, or Firm*—Aaron Nerenberg

[57] ABSTRACT

A hand operated tightening system for tightening a fastener assembly to its yield point is disclosed. The system includes a wrench for applying torque to a threaded fastener and means for mechanically differentiating the magnitude of torque applied with respect to the degree of rotation of the fastener. This differential represents the slope of the torque-rotation curve of the particular fastener assembly being tightened and is a constant while in the elastic range. Means are provided to signal a change in the magnitude of the differential so as to indicate when the yield point of the assembly has been reached. In one embodiment, the differentiating means emits an audible signal which is used to indicate that the yield point has been reached.

9 Claims, 3 Drawing Figures

HAND OPERATED YIELD TIGHTENING SYSTEM

This is a continuation of application Ser. No. 864,411, filed Dec. 27, 1977, now abandoned.

BACKGROUND OF THE INVENTION

This invention relates generally to a system and method for tightening fastener assemblies, and threaded fasteners in particular. The invention is particularly suited to the tightening of threaded fasteners to the yield point of the material comprising the assembly.

There are many different classes and types of structural joints, many of which joints are secured by mechanical fasteners. In the design of such structural joints, a desired clamping force or compressive force on the two members comprising the joint is predetermined. In some cases the predetermined clamping force is within the elastic region of the fastener, while for other applications it is desirable that the maximum clamping force be exerted and that the fastener be tightened to its yield point. Of course, uncontrolled tightening the fastener beyond its yield point could result in gross permanent deformation of the fastener, and would not be desirable.

The prior art is replete with devices and wrenching systems for applying a predetermined magnitude of torque to a threaded fastener, as evidenced by the great number of conventional torque wrenches available. One problem with conventional torque wrenches has been, as has generally been accepted, an approximate ±30% error in the correlation between the torque applied to the fastener and its resultant axial tension. This 30% error is due to variations in the coefficient of friction between the fastener and the members being joined, which results from tolerance variations and differences in the surface condition of the mating faces of the fastener and members being joined, among other variables.

U.S. Pat. No. 3,982,419 issued Sept. 28, 1976 to Boys discloses one possible tightening system for eliminating the 30% error between torque applied and the corresponding axial tension induced in the fastener assembly. The Boys system teaches the use of a wrench and appropriate electronics to tighten a fastener assembly to its yield point by developing a signal representative of the gradient of a torque vs. rotation curve, storing a gradient signal representative of the linear tightening region, and discontinuing tightening when an instantaneous gradient signal is a predetermined percentage of the stored gradient signal. While such a system is capable of accurately tightening a fastener assembly to its yield point, it may be unduly sophisticated and expensive for use in the field where a smaller, less expensive and portable device is needed.

SUMMARY OF THE INVENTION

The present invention is a tightening system adapted to tighten a fastener assembly to the yield point thereof. As is well known to those skilled in the art, the torque vs. rotation curve of a particular fastener is linear and hence has a substantially constant slope in the elastic region of the fastener assembly. When the assembly is tightened to the point where it passes beyond the elastic region, it is considered to have reached its yield point. The torque-rotation curve becomes non-linear, i.e., deviates from linearity, at the so-called yield point. The present invention includes mechanical means for differentiating the torque-rotation curve, thus producing an output indicate its slope. By monitoring a change in this output, i.e., the derivative of torque with respect to rotation, the yield point of the fastener assembly may be determined.

The invention includes a wrench having a handle connected to one end of a shaft which elastically deflects when torque is applied to a fastener. A stiff indicating rod is connected to the handle and is substantially parallel to the shaft when torque is not being applied. A calibrated gauge is connected adjacent the other end of the shaft so that the other end of the rod overlaps it. When torque is applied to the fastener and deflection of the shaft occurs, the rod remains straight and moves with respect to the calibrated gauge. The relative speed of movement between the end of the rod and the gauge is proportional to the slope of the torque-rotation curve of the fastener. Hence the relative speed between the rod and gauge serves as an output which may be monitored to determine when the fastener has reached its yield point.

Many different means may be used to monitor this speed, depending upon the degree of sophistication and type of indication that is desired. For example, the actual speed may be indicated through an electronic readout apparatus. As has been previously noted however, this is unnecessary, since a mere change in the relative speed is sufficient to indicate when the yield point has been reached. This change in speed may be indicated by any suitable means either visual or audible. In the preferred embodiment of the invention, a structurally uncomplicated mechanism has been used to audibly indicate when the fastener has been tightened so as to cause it to pass from its elastic region to its yield point. The mechanism includes uniformly spaced electrical contacts placed on a busbar which serves as a gauge. An electrically conductive wiper is connected to the end of the rod so that as torque is applied the wiper will sweep across the uniformly spaced electrical contacts. A simple electronic circuit including a battery and buzzer is connected in series to the contacts and the wiper so that each time the wiper impacts an electrical contact, a buzzing sound is emitted. While the fastener is being tightened through successive uniform applications of torque, the buzzer will sound in an intermittent manner producing a reasonably constant tone. When the yield point of the fastener has been reached, at some point during the application of torque, the spacing between successive buzzing sounds will markedly change, thus changing the tone and providing a signal to the operator that the yield point has in fact been reached.

Accordingly, it is the object of the present invention to provide a tightening system and method for tightening a fastener to its yield point.

It is an additional object of the present invention to provide a tightening system and method which includes means for mechanically differentiating the magnitude of torque applied to the fastener with respect to the degree of rotation of the fastener.

It is another object of the present invention to provide a tightening system and method for tightening a fastener to its yield point and indicating to the operator that the yield point has been reached through the change in tone of an audible signal.

It is an additional object of the present invention to provide a tightening system and method for tightening a fastener to its yield point by producing an output directly proportional to the derivative of the magnitude of torque applied to the fastener with respect to the degree of rotation of the fastener.

It is still an additional object of the present invention to provide a tightening system and method which includes means for mechanically differentiating the magnitude of torque applied to a fastener with respect to the degree of rotation of the fastener and producing an output indicative of that derivative which may be used to produce a signal when the fastener reaches its yield point.

Other objects and a fuller understanding of the invention will be had by reference to the following description and claims of a preferred embodiment thereof taken in conjunction with the accompanying drawings wherein like reference characters refer to similar parts throughout.

DESCRIPTION OF THE PREFERRED EMBODIMENT

Figure 1:
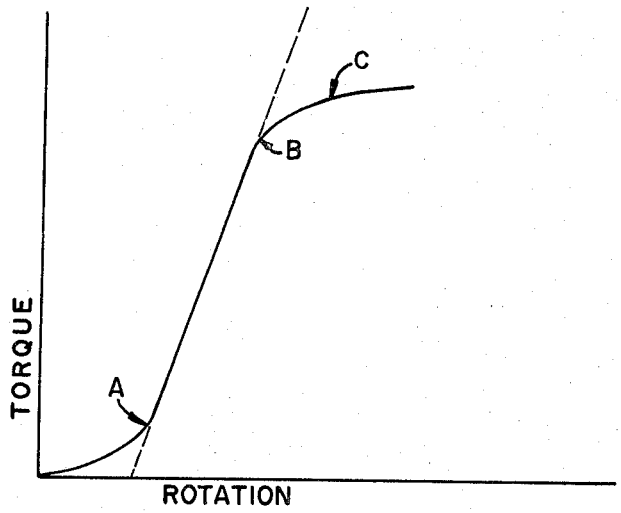
FIG. 1 is a plot of a typical torque-rotation curve for a fastener.

Referring to FIG. 1, there is shown a typical torque-rotation curve for a threaded fastener joint being tightened, which typically includes a nut and bolt combination. Torque is plotted along the vertical axis while angular displacement or the degree of rotation of the nut is plotted along the horizontal axis. A pretightening region extends from the intersection of the axes to point A. At point A the structural members are pulled together by the fastener assembly and the relationship between torque and the degree of rotation becomes linear. At point A the joint has become "snug." The amount of torque applied with respect to the degree of rotation remains linear in the A–B region until point B is reached. At point B the limit of proportionality of the joint assembly has been exceeded and the rotation of the member starts increasing at a faster rate than the torque. Point B, is thus the beginning of the yield region. Beyond point B additional load is still induced in the joint assembly but at a non-linear rate of increase. Point C generally indicates the yield point of the joint assembly. Although the definition of yield point varies slightly, it can be considered to be the point beyond which strain or stretch of the bolt is no longer purely elastic. As will become apparent, the tightening system of the present invention is capable of providing an indication as to when the joint assembly has been tightened to the yield point C on the torque-rotation curve or points between points B and C in the yield region. In certain applications points B and C may roughly correspond, but this correspondence would not affect the operation of the tightening system.

While in the preceding paragraph reference has been made to the limit of proportionality and yield point of the joint assembly, it should be noted that because of the usual design criteria, these terms usually apply to characteristics of the fastener assembly and most usually to the male fastener or bolt, since fastener assemblies are not usually as rigid as the structural members forming the joint assembly.

Figure 2:
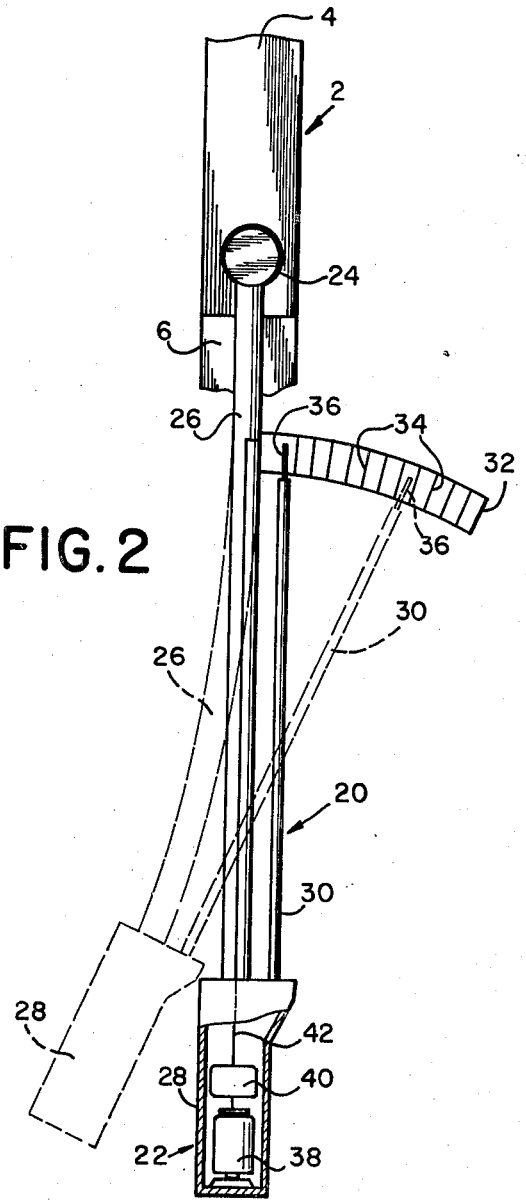
FIG. 2 is a top elevation view, partially broken away of the present invention. The position of the invention, when torque is applied, is shown in phantom.
Figure 3:
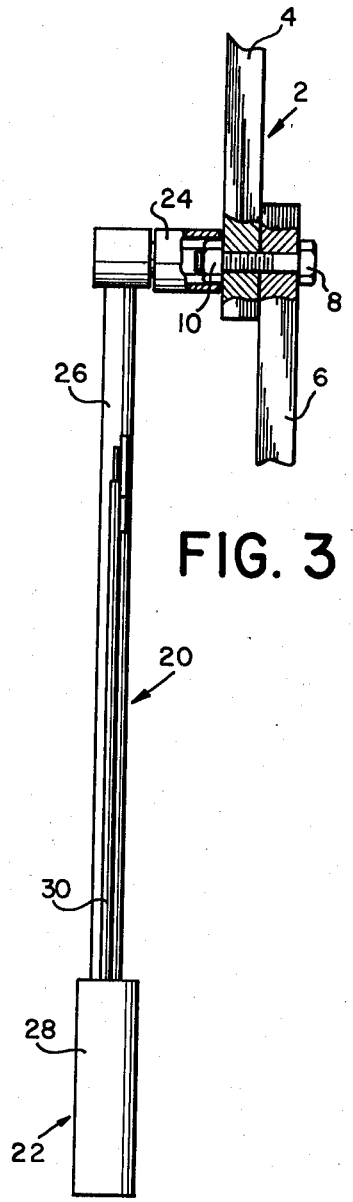
FIG. 3 is a side elevation view of the invention shown in FIG. 2.

Referring now to FIGS. 2 and 3 there is illustrated a joint assembly 2 and a tightening system or apparatus 20. The joint assembly 2 includes workpiece members 4 and 6 which are being joined together by a threaded bolt 8 and a nut 10. Members 4 and 6 are connected together and form joint assembly 2 when nut 10 is tightened onto bolt 8, as illustrated.

Tightening apparatus or system 20 includes a conventional ratchet wrench 22 having socket assembly 24, a flexible bar 26 and a handle 28. Bar 26 connects handle 28 to socket 24, so that when socket 24 engages nut 10, reciprocating motion of handle 22 will cause the nut to be tightened onto the bolt when the handle is moved in a clockwise direction, as is quite well known.

A system or apparatus for mechanically differentiating applied torque with respect to the degree of rotation includes an indicating rod 30 connected at one end to handle 28 of wrench 22. Rod 30 includes a wiper member 36 at its other, or distal end. A curved reference member or busbar 32 is connected to bar 26, generally near socket 24. It is the relative speed between wiper member 36 on rod 30 and busbar 32 which is representative of the derivative of applied torque with respect to the degree of rotation. It is thus readily apparent that when the joint assembly is being tightened in the A–B, or linear region of the torque-rotation curve, the relative speed between wiper member 36 and busbar 32 will be constant, and when the B–C region of the curve is entered, the relative speed begins to vary.

There are many different ways in which the relative speed between wiper member 36 and busbar 32 may be determined. In fact, in order to tighten the joint assembly to its yield point, it is not necessary to actually determine the relative speed but merely to determine when the speed changes magnitude, as when passing point B on the Torque-Rotation curve and continuing toward the yield point C. Any suitable means for determining the change in relative speed during a particular clockwise motion of wrench 22 or successive clockwise turns may be One such approach would be to mount a speed measuring device the end of rod 30. This and other alternative means will be readily apparent to those skilled in the art.

In the preferred embodiment of the invention, an approach was selected which does not determine actual speed but only the relative change in speed when passing from A–B region of the torque-rotation curve toward the yield point C. This is accomplished by placing uniformly spaced electrical contacts 34 on busbar 32. The electrical contacts 34 are connected in series to each other by a wire 42. Wiper 36 is adapted to make contact successively with electrical contacts 34 as torque is applied by the wrench to the fastener. Rod 30 is made of an electrically conductive material, as is handle 28 and the bar 26. The above-mentioned electrical circuit including electrical contacts 34 is thus connected through wiper member 36 and rod 30 to handle 28, which contains therein a battery 38 connected in series to a buzzer 40. Both battery 38 and buzzer 40 are appropriately positioned and secured within handle 28 by means not shown. Battery 38 makes electrical contact with the handle 28 at one end. The other pole or end of battery 38 is connected to buzzer 40 which is in turn electrically connected by wire 42 to electrical contacts 34. It is thus apparent that when the wiper 36 contacts any one of the electrical contacts 34, the electrical circuit just described is completed resulting in an audible tone being generated by buzzer 40. In order to prevent possible interference with the circuit, handle 28 may be surrounded by an electrical insulating material (not shown).

When wrench 20 is in actual use, bar 26 will deflect, as shown in phantom in FIG. 2, thus causing rod 30 to sweep across busbar 32 and resulting in the buzzer emitting an audible tone having a unique tonal characteristic due to the speed with which wiper 36 comes in contact with electrical contacts 34. When the joint assembly 2 has been tightened to the yield point (or in the yield region) of the joint assembly, the derivative of the applied torque with respect to the degree of rotation changes, thus resulting in a change in speed with which wiper 36 sweeps across electrical contacts 34 and producing a change in the tone issued by the buzzer 40. The operator or user of tightening system 30 will thus be aware of the fact that the joint assembly 2 has been tightened to its yield point by this change in tone and may then cease applying further torque. The tonal change of the buzzer may occur while a particular clockwise application of torque is in progress or may appear to occur between successive applications of clockwise torque. In order to be most effective it is necessary that the operator of system 20 be made aware that torque should be applied to wrench 22 in a uniform and continuous manner after the joint assembly has been "snugged" together, as irregular or jerking applications of torque will, in and of themselves, produce erroneous and spurious tonal changes which may result in the operator ceasing to apply torque prior to reaching the yield point of the joint assembly.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. A tightening system for tightening a fastener assembly including a threaded fastener to the yield point thereof, comprising:

wrench means for applying torque and imparting rotation to the threaded fastener when operably connected thereto;

mechanical differentiation means connected to said wrench means for differentiating the magnitude of said torque with respect to the degree of said rotation, said differentiation resulting in the generation of discrete, intermittent output parameter signals, the rate of occurrence of successive output parameter signals being substantially directly proportional to the slope of a Torque-Rotation curve which could be generated for the fastener assembly being tightened; and indicating means adapted to receive said differentiating means output parameter signals for providing an indication signal when a change in the frequency of successive discrete, intermittent output parameter signals occurs indicative of a change in the slope of the curve, thereby indicating when the fastener assembly has been tightened to the yield point thereof.

2. A tightening system in accordance with claim 1 wherein said indication signal is an audible signal.

3. A tightening system for tightening a fastener assembly including a threaded bolt and a nut adapted to engage the threads of the bolt, the system being adapted to determine the yield point of the fastener assembly, comprising:

wrench means for applying torque and imparting rotation to one member of the fastener assembly when operably connected thereto;

mechanical differentiating means connected to said wrench means, including an output member adapted to be in motion when said wrench means is imparting rotation to said one member of the fastener assembly, the speed of said motion being substantially proportional to the slope of a Torque-Rotation curve which could be generated for the fastener assembly being tightened; and indicating means operatively connected to said output member, said indicating means producing a series of successive discrete output signals, the rate of occurrence of said output signals being substantially proportional to the slope of said Torque-Rotation curve, thereby indicating when the fastener assembly has been tightened to the yield point thereof by the observation of a change in the rate of occurrence of successive ones of said signals.

4. A tightening system in accordance with claim 3 wherein said indicating means output signals are audible signals.

5. A tightening system in accordance with claim 3 wherein said wrench means includes a socket for engaging said one member of the fastener assembly, a flexible bar connected at one end thereof to said socket, and a handle connected to the other end of said bar, and wherein said output member includes an elongated rod connected at one end thereof to said handle, and said differentiating means further includes a reference member attached to said bar intermediate the ends thereof, said rod overlapping said reference member and the speed of said motion therebetween being proportional to the slope of said Torque-Rotation curve.

6. A tightening system in accordance with claim 5 wherein said indicating means includes an electrical circuit, comprising:

a power source operatively contacting said handle;

audible means operatively attached to said power source;

a plurality of electrical contacts uniformly spaced and operatively attached to said reference member, and operatively connected to said audible means; and an electrically conductive wiper connected to said rod and adapted to contact successive ones of said electrical contacts when said rod is in motion, thereby successively and intermittently completing said electrical circuit and causing intermittent actuation of said audible means.

7. A tightening system in accordance with claim 6 wherein said audible means is a buzzer and whereby the frequency of actuation of said buzzer is indicative of said slope, and whereby a change in said frequency indicates a change in said slope and is thus indicative of the fastener having been tightened to yield point.

8. A method of tightening a fastener assembly comprising the steps of:

applying torque and imparting rotation to the fastener assembly;

mechanically differentiating the magnitude of said torque with respect to the degree of said rotation for producing discrete, intermittent output parameter signals, the rate of occurrence of successive output parameter signals being substantially directly proportional to the slope of a torque-rotation curve which could be generated for the fastener assembly being tightened;

monitoring said discrete, intermittent output parameter signals; and providing an indication when a change in the frequency of successive discrete, intermittent output parameter signals occurs indicative of a change in the slope of said torque-rotation curve, thereby indicating when the fastener assembly has been tightened to the yield point thereof.

9. A method of tightening a fastener assembly in accordance with claim 8 wherein said indication signal is an audible signal.

* * * * *